US007510319B2

(12) United States Patent
Hood

(10) Patent No.: US 7,510,319 B2
(45) Date of Patent: Mar. 31, 2009

(54) MIXING APPARATUS FOR CONCRETE

(76) Inventor: George Max Hood, 17 Serpentine Road, Erina Heights, New South Wales, 2260 (AU)

( * ) Notice: Subject to any disclaimer, the term of this patent is extended or adjusted under 35 U.S.C. 154(b) by 455 days.

(21) Appl. No.: 10/527,613

(22) PCT Filed: Sep. 10, 2003

(86) PCT No.: PCT/AU03/01180

§ 371 (c)(1),
(2), (4) Date: Sep. 21, 2005

(87) PCT Pub. No.: WO2004/024409

PCT Pub. Date: Mar. 25, 2004

(65) Prior Publication Data

US 2006/0098526 A1 May 11, 2006

(51) Int. Cl.
*B28C 5/42* (2006.01)

(52) U.S. Cl. ..... 366/59

(58) Field of Classification Search ..... 366/57, 366/56, 59, 54

See application file for complete search history.

(56) References Cited

U.S. PATENT DOCUMENTS

| | | | | | |
|---|---|---|---|---|---|
| 2,338,820 | A | * | 1/1944 | Peters | 366/44 |
| RE23,320 | E | * | 1/1951 | Willard et al. | 366/44 |
| 2,611,591 | A | * | 9/1952 | Longenecker | 366/59 |
| 2,618,472 | A | * | 11/1952 | Castendyck | 366/44 |
| 3,328,006 | A | * | 6/1967 | Buelow et al. | 366/59 |
| 3,795,121 | A | * | 3/1974 | Cressman | 366/59 |
| 4,187,028 | A | * | 2/1980 | Pawley | 366/44 |
| 4,188,127 | A | * | 2/1980 | Pawley | 366/54 |

(Continued)

FOREIGN PATENT DOCUMENTS

JP 2002154112 * 5/2002

OTHER PUBLICATIONS

International Search Report for Application No. PCT/AU03/01180, completed Oct. 14, 2003, mailed Oct. 22, 2003.

*Primary Examiner*—Tony G Soohoo
(74) *Attorney, Agent, or Firm*—Dority & Manning, P.A.

(57) ABSTRACT

A truck mounted concrete mixer includes a mixing drum (1) rotatable about longitudinal axis (2) having a drum head (3) and an open end (4) to receive batch materials to be mixed. A pair of generally helical mixing blades (5) are disposed within the drum (1) but instead of extending to the drum head (3) as occurs in standard concrete mixers, the mixing blades terminate short of the drum head (3) and a second blade (6) extends from each mixing blade (5) toward the drum head (3) at an angle of about 90° to the helical blade (5) and at a height greater than that of the adjoining mixing blade. This height difference defines a spillway formation (7) above the mixing blade (5). In use, the second blade (6) acts to push or mechanically transfer material from near the drum head to the center bottom area of the drum into an air gap above the material where it cascades down over the spillway formation upon mixing rotation of the drum which has the effect of maximizing frictional and impact forces and breaking open lumps and agglomerations formed in the material. The material then re-engages the main mixing blade (5) and is wound forward once again repeating the mechanically induced mixing action.

17 Claims, 4 Drawing Sheets

U.S. PATENT DOCUMENTS 4,730,934 A * 3/1988 Schwing ..... 366/44
5,839,824 A * 11/1998 Backman et al. ..... 366/59
6,149,291 A * 11/2000 Christenson ..... 366/59
2006/0098526 A1 5/2006 Hood

* cited by examiner

MIXING APPARATUS FOR CONCRETE

FIELD OF THE INVENTION

The present invention relates to concrete mixers and in particular to truck mountable concrete mixers. It has been developed primarily for use as a concrete mixer mountable on a truck chassis to allow weigh batched concrete ingredients to be mixed and adjusted for slump at a batch plant prior to the mixer's departure. Whilst en route, the mixer drum is slowly rotated in order to prevent the wet concrete from segregating. It will be appreciated that transit mixers are not limited to the above field and are sometimes used to mix other materials.

BACKGROUND OF THE INVENTION

Known concrete transit mixers are typically constructed by mounting a concrete mixing assembly to a truck chassis. The mixing assembly includes a concrete mixing drum rotatably supported by front and rear drum support pedestals. These pedestals are fixedly connected to a rectilinear bracket, which is in turn used to secure the assembly to the truck chassis.

Most transit mixers include an open mouthed mixing drum, typically inclined rearwardly at an angle of approximately 14 degrees to the horizontal. There are generally two helical mixing blades 180° apart mounted to the interior surface of the drum. Each blade is similar to an Archimedean screw, except that the pitch and height of the blade often varies along the length of the drum. Normally, the blades have a close pitch and relatively low height near the mouth of the drum and develop continuously in a clockwise direction (or right handed sense) to a relatively large pitch and greater height as the drum diameter increases toward the closed front end adjacent the drum head. The term "clockwise" (and anti-clockwise) when used in conjunction with mixing blade in the context of this application refers to the direction that the drum of the transit mixer is rotated to cause the mixing blades to mix the material in the drum by driving the material forward towards the drum head when viewed from the drum head looking back towards the open end of the drum. As is discussed in more detail below in those countries where vehicles drive on the left hand side of the road clockwise blades are the norm, whereas in right hand drive countries anticlockwise blades are used. The drum is usually rotatably driven about its inclined axis by an hydraulic motor or internal combustion engine connected to the drum head. Existing drums built in Australia usually have a maximum diameter of 2300 mm.

When dry batch ingredients such as sand, stone and cement are fed into the mixer through the open mouth with a suitable quantity of water, the helical mixing blades tend to wind the material progressively forward towards the drum head. During this movement, in prior art transit mixers the helical blades propel the ingredients downward toward the drum head. As the material cannot proceed any further, it accumulates and builds up towards the upper region of the drum head and then folds over itself and through the force of extrusion is driven back toward the rear opening. As the mixing volume is usually about 60% of the total drum volume, the material moving toward the opening slides downward and becomes re-engaged with the lower blades and is once again wound downward toward the drum head. The continuation of this action at about eighteen revolutions per minute for many minutes finally achieves mix uniformity and provides the slump required by the customer.

The mixing time, or total number of revolutions of the drum required to mix the ingredients uniformly, is dependent on a number of factors including:—

(1) The mixing speed;
(2) The shape and volume of the mixing drum;
(3) The design of the mixing blades; and
(4) The mix formulae.

In Australia, any truck mounted mixer must comply with Australian Standard AS 1379-1997 in terms of uniformity of mixing. This test is generally referred to as the "mixing efficiency test". It has been found that if a truck mounted mixer is to achieve the required degree of uniformity in mixing, the blades must not only induce a rotating motion of the concrete mass parallel to the rotational axis of the drum, but even more importantly, an overall end to end mixing action so that the concrete is uniform throughout its mass.

While most conventional transit mixers can achieve the requirements of AS1379-1997, it is commonly accepted that their mixing efficiency is overshadowed by that of heavy duty central drum mixers which achieve the required uniformity within around a third to a quarter of the time. It is also well known that transit mixers require a higher proportion of cement to be added to their mixes in order to achieve the concrete strength usually obtainable by formulations mixed in central drum mixers.

The main explanation for the superior performance lies in the following characteristics of the central drum mixer:—

(1) Shape and larger diameter of the mixing drum;
(2) Larger internal drum volume (typically around 20 m3 for a 6 m load); and
(3) Mixing blade design adapted to lift material from one side of the drum and discharge in a criss-cross cascading action to the opposite side.

The concrete cascading down on itself induces high impact and frictional forces. According to Portland cement experts, and other authorities these forces are capable of crushing residual cement agglomerations and releasing the entrapped cementitious material for hydration. This leads to central drum mixers requiring a lower proportion of cement in their mixes than would be required by transit mixers to achieve the same ultimate concrete strength. There is a long felt need to provide a truck mounted concrete mixer with a mixing efficiency speed and performance comparable with those of a 20 tonne central drum mixer.

As previously mentioned, both Portland cement experts and indeed most authorities recognise the superior mixing efficiency and reduced mixing time in 6 $m^3$ stationary drum mixers compared to transit mixers. Also, many government authorities often specify the use of large central mixers for concrete to be used in critical mass concrete structures.

Portland cement experts have determined that when dry cement powder comes into contact with water there is a natural tendency for cement agglomerations to form. The common use of chemical additives also assists in the creation of myriads of cocoons, which although entrapping thousands of micron sized cement particles, and water, merely float again in the load due to the gentle folding action of prior art transit mixers. The cement in these cocoons thus never becomes hydrated. By contrast, the cascading turbulence, and friction created in a central drum mixer crushes the agglomerations, releasing the entrapped cement for hydration and thereby resulting in higher strengths and shorter mixing times in central mixers. The agglomerations range in size from minute to golf or even tennis ball size. Agglomerations reduce the strength of the concrete and create other problems. In particular, when the concrete is laid and set, if one of the agglomerations is located at an outer edge of the concrete so it is exposed to atmosphere, it may crumbles or be washed out to leave an unsightly hole. If the lump should be located in a beam, it could adversely affect the strength of that beam.

AU 652893 discloses one attempt to overcome the problems of the prior art discussed above. This patent describes a truck mounted mixing apparatus for concrete which includes a wedge shaped "bucket" formation in the vicinity of the drum head located between the drum and the end of the main blade flight. The angle of the wedge is 23°. On rotation of the drum, the bucket is intended to fill with material from the bottom of the drum and elevate that material for discharge towards the top of the drum head thus aiding extrusion towards the open end and helping to promote end to end mixing within the drum. However whilst the apparatus of AU 652893 was found to assist with sloppy (high slump) concrete, the apparatus tending to raise the sloppy concrete to the upper part of the drum head where it subsequently extruded and slid downwards towards the mouth of the drum on top of the material in the drum, it was later discovered that it did not work with high cement content, low slump concrete. It was found that the drier low slump concrete became wedged or jammed in the drum head bucket instead of being discharged towards the top of the drum end, and thus the apparatus did not work as intended. A further problem which was found to arise was that concrete would remain wedged in the bucket during discharge even after the rest of the load had been discharged. To remove the wedged/stuck concrete it was necessary to wet it down after which that part of the load was unacceptable for use in building. Thus the invention which is the subject of AU 658893 has not been commercially successful with low slump concrete.

It is an object of the invention to overcome or ameliorate one or more of the deficiencies of the prior art, or at least to provide a useful alternative.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

Accordingly, the invention provides a mixing apparatus for concrete including:

a mixing drum supported for rotation about a longitudinal axis, the drum having a closed end defined by a drum head and an open end to receive batch materials to be mixed;

a first, generally helical, mixing blade disposed within the drum and extending towards the drum head; and a second blade extending at an angle from the mixing blade toward the drum head, the second blade being adapted upon mixing rotation of the drum to push/mechanically transfer material from the bottom of the drum near the drum head and to elevate the material for cascading discharge toward the open end of the drum and downward toward the area of largest diameter of the drum.

Advantageously the second blade acts to push or mechanically transfer material from near the bottom of the drum into an air gap above the material where it cascades down upon mixing rotation of the drum. Importantly, the second blade directs material from near the bottom of the drum near the drum head and not only pushes material upwards, it also pushes material backwards towards the middle of the drum where the drum is typically tallest. The material then cascades down and impacts onto the material below with some force. This cascading of the material has the effect of impacting and breaking lumps and agglomerations formed in the material.

Most preferably, the helical mixing blade terminates at the second blade.

Typically, the helical mixing blade will develop in a clockwise direction (or right handed sense) from an open end of the drum towards the drum head and the second blade extends in an anti-clockwise direction or left handed sense towards the drum head.

It is preferred that the second blade meets the helical mixing blade at an angle of about 90° to 100° with acute angles being avoided. The preferred angle is 90°. The main body of the blade may be bent at a location spaced from the intersection between the second blade and the helical mixing blade to achieve a more acute angle to speed up the mixing of the concrete.

Typically the drum will comprise a first frustro-conical portion extending from a relatively small diameter open end to a generally cylindrical central portion having a greater diameter, most preferably about 2450 mm, and a second frustro-conical portion which gradually narrows to a concave plate which defines the drum head.

Most preferably the second blade intersects with the helical mixing blade in the second frustro-conical portion near to where the central portion meets the second frustro-conical portion.

Preferably, the mixing blade defines a spillway adjacent the second blade and the height of the second blade is greater than the height of the adjoining mixing blade at the point of intersection, thereby to define one sidewall of the a spillway at the intersection.

In a preferred embodiment, the second blade is tapered, progressively reducing in height from near the mixing blade to near the drum head.

Most preferably, the mixing blade terminates at the second blade.

The apparatus preferably includes a discharge blade extending from near the drum head and terminating near the second blade. Preferably, the height of the discharge blade is around half the height of the mixing blade.

Preferably, the apparatus includes a pair of mixing blades, each including a respective second blade. More preferably, each mixing blade includes a drainage hole adjacent its respective second blade.

Preferably, the mixing drum is supported on a truck for rotation about a longitudinal axis inclined at between 10° and 20° to the horizontal, most preferably about 13°.

BRIEF DESCRIPTION OF THE DRAWINGS

A preferred embodiment of the invention will now be described, by way of example only, with reference to the accompanying drawings in which.

PREFERRED EMBODIMENTS OF THE INVENTION

Figure 1:
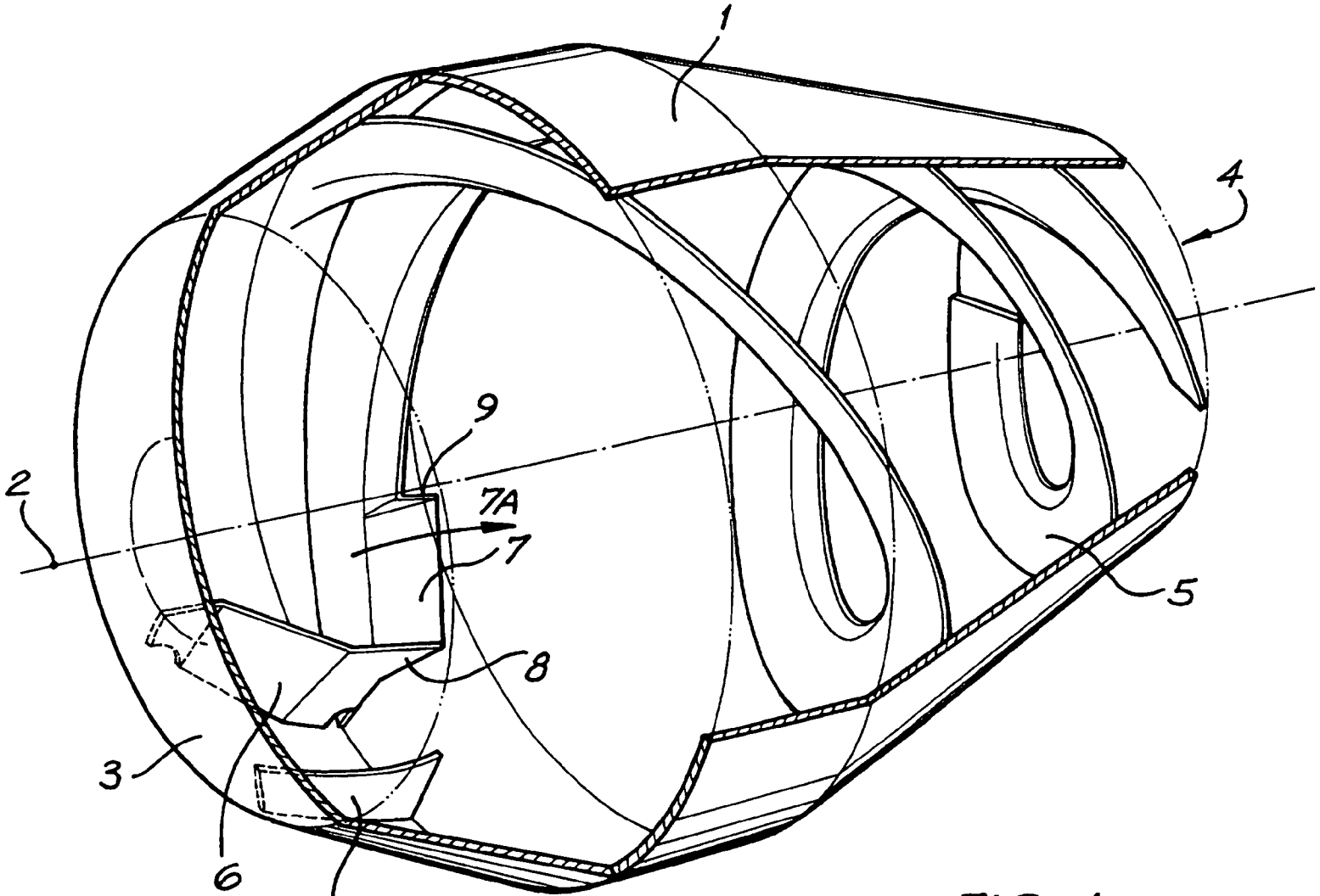
FIG. 1 is a cut-away perspective view of a mixing apparatus according to a first embodiment of the invention.

Referring to the drawings, a concrete mixing apparatus includes a mixing drum 1 supported for rotation about a longitudinal axis 2. The drum has a closed end defined by a drum head 3 and an open end 4 to receive batch materials to be mixed. A pair of generally helical Archimedean screw type mixing blades 5 (only one mixing blade is shown for ease of illustration) are disposed within the drum 1. Each mixing blade has a height of about 350 mm. Instead of extending as far as the drum head 3 in a clockwise direction (or right handed sense) as occurs in standard concrete mixers, the helical mixing blades terminate short of the drum head 3 and a second blade 6 extends from each mixing blade 5 toward the drum head 3 at an angle $\alpha$ of about 90° to 100°, most preferably about 90°, to the tangent to the mixing blade 5 at a height greater than that of the adjoining mixing blade 5. The blade extends in a reverse (anti-clockwise) direction compared to the clockwise mixing blade.

Figure 2:
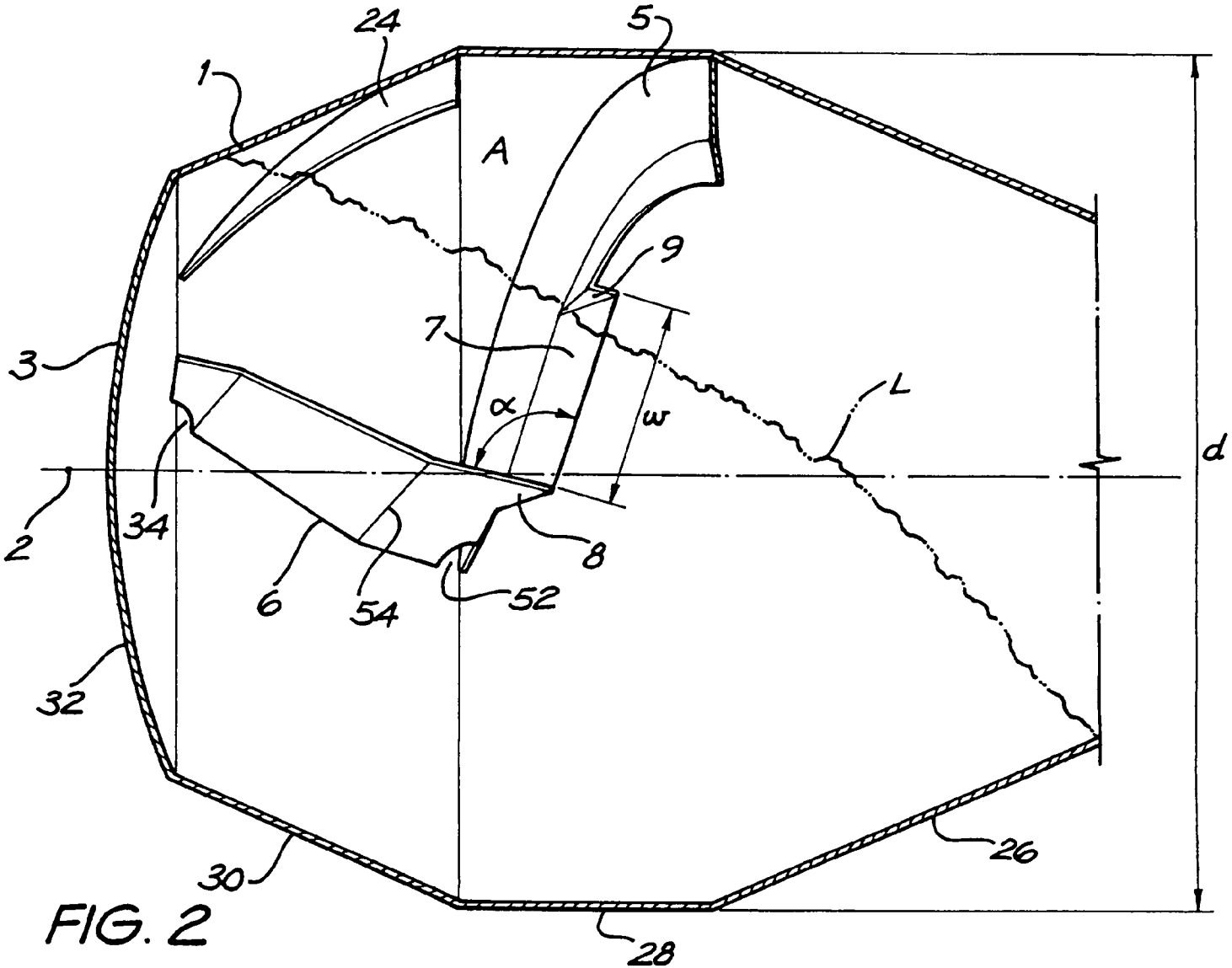
FIG. 2 is a schematic side view of the mixing apparatus of FIG. 1.
Figure 3:
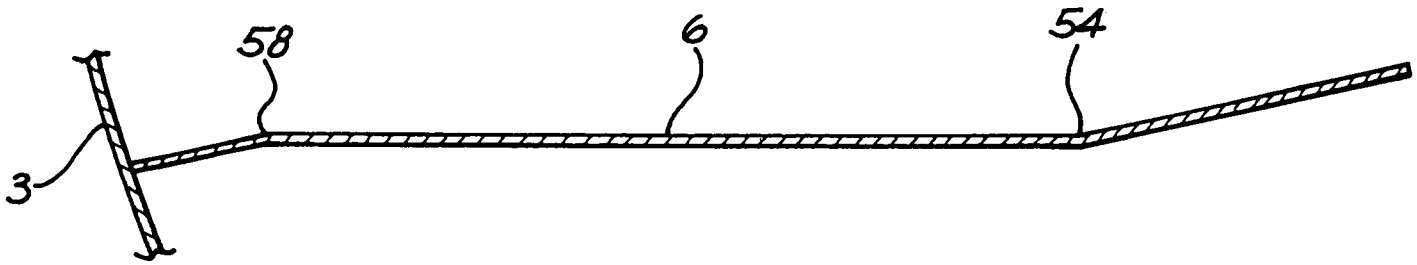
FIG. 3 is a plan view of a second blade for the mixing apparatus of FIG. 1.
Figure 4:
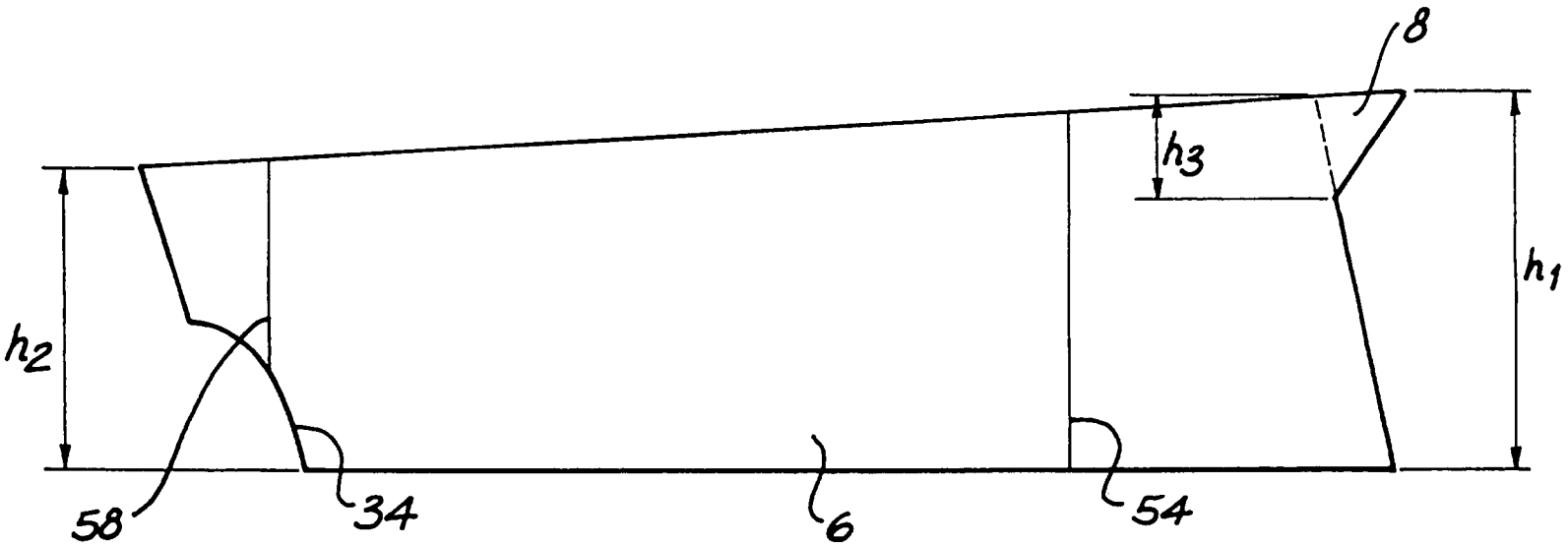
FIG. 4 is a side view of the blade of FIG. 3.

The second blade 6 is shown in more detail in FIGS. 3 and 4. It is approximately 1 m long incorporates a first bend 54 and a second bend 58, and its distal end is curved to fit the drum head. The second bend is provided to ensure that the blade 6 meets the drum head at an angle of about 90° rather than an acute angle. The first bend 54 allows the blade to steepen its angle to increase the flow rate of material, as is discussed in more detail below. Each second blade 6 has a height $h_1$ of 400 mm at the proximal end that joins the mixing blade 5 and tapers to a height $h_2$ of 300 mm at the distal end where it joins the drum head 3. The blade 6 further defines at the proximal end, a projecting guide wall 8 having a height $h_3$ of 100 mm extending above the mixing blade toward the open end 4 of the drum and at its distal end defines a curved drainage hole 34 to prevent build up of material. There is a similar drainage hole 52 in the other end of the blade where it joins the mixing blade 5. Reverting to FIG. 2, the mixing blade 5 defines a spillway lip 9 which extends generally parallel to lip 8 along an upper edge of the mixing blade 5. A spillway 7 having a width w of 600 mm extends between the spillway lips 8 and 9.

With reference to FIG. 2, the drum comprises a first frustro-conical portion 26 extending from the relatively small diameter open end 4 to a generally cylindrical central portion 28 having a relatively greater diameter, "d' most preferably about 2450 mm, and a second frustro-conical portion 30 which gradually narrows to a concave plate 32 which defines the drum head 3. The 2450 mm diameter "d" of the central (widest) part 28 of the drum is about 150 mm greater than a standard truck mounted mixing apparatus. The frustro-conical section 30 between the central part 28 and the drum head 3 is also somewhat more steeply angled at an angle $\beta$ (14° ) to the truck axis T which is horizontal when the truck is on a level road, than a typical existing truck mounted mixing apparatus. Note that the truck axis T is itself at an angle of 13° to the longitudinal axis 2 of the drum.

In use as the drum is rotated in a clockwise direction when viewed from the drum head looking towards the open end 4, the second blade 6 acts to push or mechanically transfer material from near the drum head to the centre bottom area of the drum into an air gap "A" above the material where it cascades down past the blade 6 in the direction of arrow F and over the spillway formation 7 in the direction indicated by arrow 7A upon mixing rotation of the drum. Together, the guide wall 8 and spillway lip 9 direct material flowing across the spillway 7 toward the open end 4 of the drum.

In FIG. 2 the line L indicates the typical surface level of the top of the material in the drum when the drum is "full". Only the part of the helical mixing blade 5 closest to the blade 6 is shown in FIG. 2.

Importantly, the second blade 6 directs material from near the drum head area and not only pushes material upwards, it also pushes material backwards towards the middle of the drum where the drum is tallest/widest. As the drum rotates, the material flows over the spillway and cascades down and impacts onto material below with some force. This cascading of the material has the effect of maximising frictional and impact forces and breaking open lumps and agglomerations formed in the material and releasing more cementitious material and water for hydration.

As discussed above, the 90° conjunction of the blades 5 and 6 carries the material up to the airspace during which time material continues to flow over the spillway and cascades down onto the lower level of material in the bottom area of the rear cone 26. At this point the material re-engages the helical mixing blade 5 and is wound forward once again repeating the mechanically induced mixing action.

Figures 5, 6:
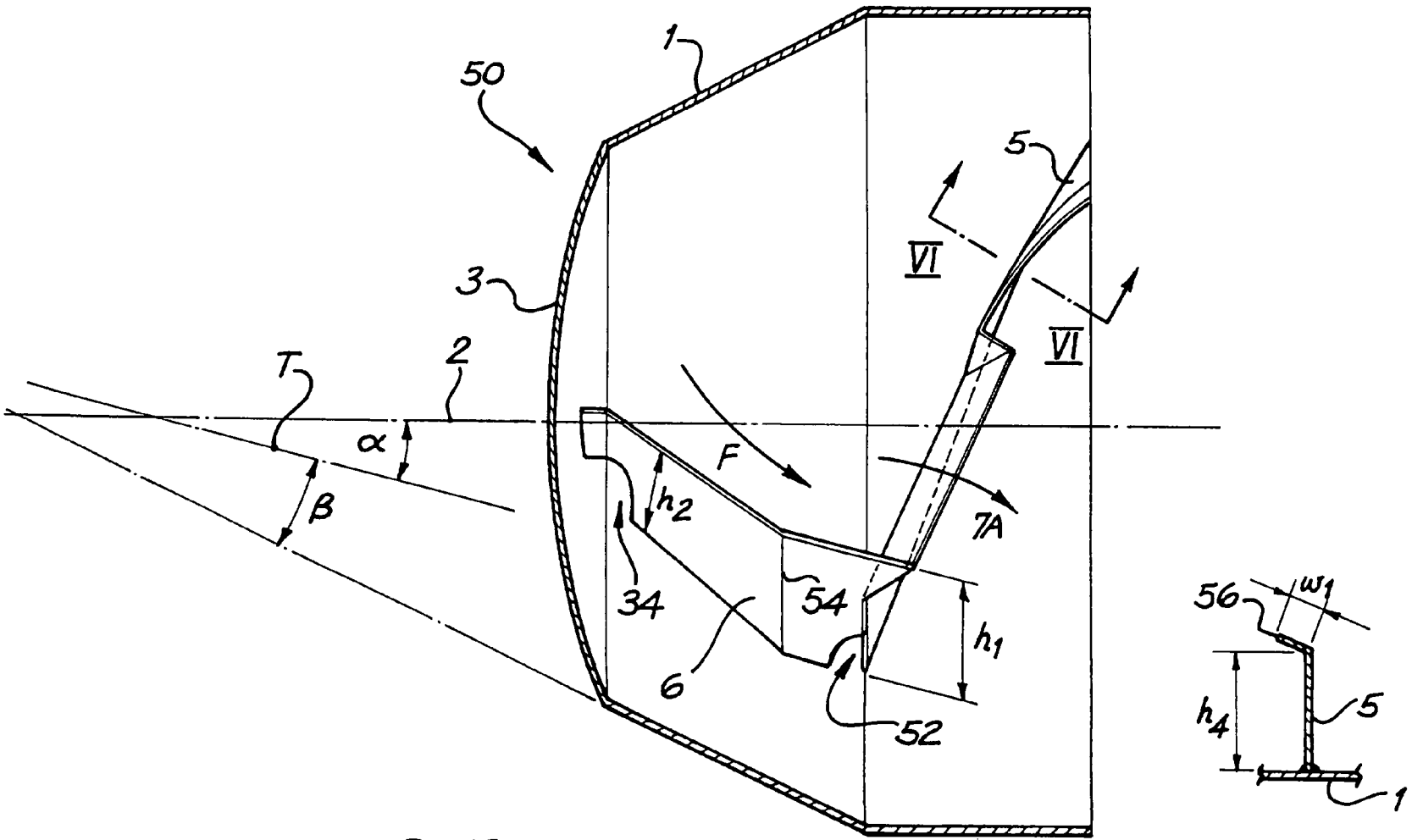
FIG. 5 is a schematic side view of a second embodiment of the invention.
FIG. 6 is a section through a mixing blade on VI-VI of FIG. 5.

It should also be noted that the helical blades 5 may have only about two turns or less in the embodiment of the mixing apparatus described herein (the helical mixing blade having 1¾ turns in a clockwise direction, and the second blade ¼ turn anti-clockwise) which is fewer turns than a typical standard mixing apparatus which typically has 2½ turns. As discussed above the blades have a height $h_4$ of 350 mm whilst most typical existing blades are about 450 mm in height. As best seen in FIG. 6 the mixing blades also define a steel wear strip 56 which has a width $w_2$ of 75 mm and a thickness of 8 mm. The reduced blade height reduces the area of mixing blade which has to be maintained. Since a standard mixing apparatus works by moving the material to the drum head and applying pressure to that material so that the material builds up at the drum head and extrudes or slides along the top of the material in the drum, a relatively tighter spiral is required to maintain the necessary pressure on the material. The more efficient mixing apparatus described herein can function with a shallower helical blade. This has the advantage that the drum can be rotated more slowly when mixing concrete than existing mixing apparatus but can still move the material to the drum head faster than a typical standard mixing apparatus even when the drum is turning at only 12 rpm. Typically, the drum is rotated at 10 to 12 rpm (12 rpm giving a peripheral velocity of the exterior of the drum as 92 m/min) as opposed to existing mixing apparatus which are turned at about 18 rpm—giving a peripheral velocity of about 130 m/min.

Generally, the mixing drum is supported on a truck (not shown) for rotation about the longitudinal axis 2 inclined at an angle $\alpha$ of between 10° and 20° to the horizontal. As discussed above, most preferably the drum axis is inclined at an angle of 13° to the horizontal. This is somewhat more horizontal than typical existing mixing apparatus and has the advantage that it is easier to move the concrete from end to end, and in particular when discharging the mixed concrete. The methods of supporting, driving and controlling the rotation of the drum are conventional, and being well understood by those skilled in the art, need not be described in further detail.

As shown in FIGS. 1 and 2 the mixing apparatus includes a discharge blade 24. The blade is about 150 mm high and when the drum is counter-rotated for discharge assists in the discharge of mixed concrete, particularly low slump concrete. Because the frustro-conical section 22 is steeply angled, the discharge blade is not required for average slump concrete and can be omitted. FIG. 5 shows such an embodiment 50 in which there is no discharge blade but which is otherwise identical to the first embodiment of FIGS. 1 and 2. The Figure shows a drainage hole 52 at the intersection of the blades 5 and 6.

It will be appreciated that the illustrated mixing apparatus mechanically transfers wet concrete adjacent the drum head and discharges the concrete from near the top of the central part of drum where it falls up to 2 m in a cascading action similar to that seen in central drum mixers. In testing it has been found that the apparatus described above will mix a load of concrete in about half the time taken by existing mixers. The quality and workability of the mixed concrete is also significantly improved with the substantial majority of agglomerations of Portland cement being destroyed. The concrete is found to be creamier, "less bony" and easier to finish and also uses less water which can only arise as a result of the crushed agglomerations. The reduced mixing time not only provides significant advantages in production and efficiency, it also reduces wear and tear on the apparatus particularly in conjunction with the slower rotation of the drum production of concrete in half the time taken by existing mixers and uses less energy in the mixing process and may substantially reduce typical maintenance costs.

It has been found in practice that the invention as described produces faster mixing times, higher mixing efficiencies, requires a lower proportion of cement, and produces a stronger concrete formulation with respect to conventional transit mixers of comparable capacity. Without wishing to constrain the efficacy of the invention to any particular theoretical exposition, it is believed that these advantages are conferred as a result of the cascading motion induced by the reverse and supplementary blades emulating in some respects the operation of a central drum mixer. In any event, the performance enhancements represent both practical and commercially significant improvements over the prior art.

It will be appreciated by persons skilled in the art that the mixing blades may be clockwise or anti-clockwise depending on the country in which the mixer is to be used, with clockwise blades used in countries where vehicles drive on the left to keep the load to the high side (centre) of the road in use. The blades turning clockwise (as viewed from the front of the vehicle tend to ensure centre of mass of the load is to the left of the vehicle. This helps prevent the truck tipping when turning corners, particularly relatively steeply cambered corners. In countries such as the USA and continental European countries where vehicles drive on the right, the blades are fitted in the opposite sense.

Although the invention has been described with reference to specific examples, it will be appreciated by those skilled in the art that it may be embodied in many other forms.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A mixing apparatus for concrete including:

a mixing drum supported for rotation about a longitudinal axis, the drum having a closed end defined by a drum head and an open end to receive batch materials to be mixed;

a first, generally helical, mixing blade disposed within the drum and extending towards the drum head; and a second blade extending at an angle from the first, generally helical, mixing blade toward the drum head, the second blade being adapted upon mixing rotation of the drum to push/mechanically transfer material from the bottom of the drum near the drum head and to elevate the material for cascading discharge toward the open end of the drum and downward toward the area of largest diameter of the drum and wherein;

the first, generally helical, mixing blade develops in a counter-clockwise direction from an open end of the drum towards the drum head and the second blade extends in a clockwise direction towards the drum head; and wherein the first, generally helical, mixing blade defines a spillway formation adjacent the second blade and wherein the height of the second blade is greater than the height of the adjoining mixing blade at the point of intersection of the first, generally helical, mixing blade and the second blade, thereby to define a side wall of the spillway formation.

2. A mixing apparatus as claimed in claim 1 wherein the first, generally helical, mixing blade terminates at the second blade.

3. A mixing apparatus as claimed in claim 1 wherein the second blade meets the helical mixing blade at an angle of about 90° to 100°.

4. A mixing apparatus as claimed in claim 1 wherein the second blade meets the helical mixing blade at an angle of about 90°.

5. A mixing apparatus as claimed in claim 1 wherein the second blade is bent at a location spaced from the helical mixing blade.

6. A mixing apparatus as claimed in claim 1 wherein the drum comprises a first frustro-conical portion extending from a relatively smaller diameter open end to a generally cylindrical central portion having a relatively larger diameter, and a second frustro-conical portion which gradually narrows to a concave plate which defines the drum head.

7. A mixing apparatus as claimed in claim 6 wherein the second blade meets the first, generally helical, mixing blade in the second frustro-conical portion near to where the central portion meets the second frustro-conical portion.

8. A mixing apparatus as claimed in claim 1 wherein the second blade is tapered, progressively reducing in height from near the mixing blade to near the drum head.

9. A mixing apparatus as claimed in claim 1 wherein the apparatus further includes a discharge blade extending from near the drum head and terminating near the second blade.

10. A mixing apparatus as claimed in claim 1 wherein the apparatus further includes a pair of mixing blades, each including a respective second blade.

11. A mixing apparatus as claimed in claim 1 wherein the second blade includes one or more drainage holes.

12. A mixing apparatus as claimed in claim 11 wherein one drainage hole is located where the second blade meets the drum head.

13. A mixing apparatus as claimed in claim 11 wherein one drainage hole is located where the second blade meets the first, generally helical, mixing blade.

14. A mixing apparatus as claimed in claim 1 wherein the mixing drum is supported on a truck for rotation about a longitudinal axis inclined at about 13° to the horizontal.

15. A mixing apparatus for concrete including:

a mixing drum supported for rotation about a longitudinal axis, the drum having a closed end defined by a drum head and an open end to receive batch materials to be mixed;

a first, generally helical, mixing blade disposed within the drum and extending towards the drum head; and a second blade extending at an angle from the first, generally helical, mixing blade toward the drum head, the second blade being adapted upon mixing rotation of the drum to push/mechanically transfer material from the bottom of the drum near the drum head and to elevate the material for cascading discharge toward the open end of the drum and downward toward the area of largest diameter of the drum; and wherein the first, generally helical, mixing blade develops in a clockwise direction from an open end of the drum towards the drum head and the second blade extends in a counter-clockwise direction towards the drum head; and wherein the first, generally helical, mixing blade defines a spillway formation adjacent the second blade and wherein the height of the second blade is greater than the height of the adjoining mixing blade at the point of intersection of the first, generally helical, mixing blade and the second blade, thereby to define a side wall of the spillway formation.

16. A mixing apparatus for concrete including:

a mixing drum supported for rotation about a longitudinal axis, the drum having a closed end defined by a drum head and an open end to receive batch materials to be mixed;

a first, generally helical, mixing blade disposed within the drum and extending towards the drum head which terminates before the drum head at a second blade extending at an angle of about 90° to 100° from the first, generally helical, mixing blade toward the drum head, the second blade being adapted upon mixing rotation of the drum to push/mechanically transfer material from the bottom of the drum near the drum head and to elevate the material for cascading discharge toward the open end of the drum and downward toward the area of largest diameter of the drum and wherein;

the first, generally helical, mixing blade helical mixing blade develops in a counter-clockwise direction from an open end of the drum towards the drum head and the second blade extends in a clockwise direction towards the drum head; and wherein the first, generally helical, mixing blade defines a spillway formation adjacent the second blade and wherein the height of the second blade is greater than the height of the adjoining mixing blade at the point of intersection of the first, generally helical, mixing blade and the second blade, thereby to define a side wall of the spillway formation.

17. A mixing apparatus as claimed in claim 16 wherein the mixing drum is supported on a truck for rotation about a longitudinal axis inclined at about 13° to the horizontal.

* * * * *